US005713606A

United States Patent [19]

Kleinberg et al.

[11] Patent Number: 5,713,606

[45] Date of Patent: Feb. 3, 1998

[54] BOOKMARK AND PAGE COMBINATION FOR A BOOK, MAGAZINE, TRADE JOURNAL, PROFESSIONAL JOURNAL, CATALOG, AND LIKE PUBLICATION

[75] Inventors: Kimberly Lee Kleinberg; Gary Alfred Walchli, both of Baltimore, Md.

[73] Assignee: Waverly, Inc., Baltimore, Md.

[21] Appl. No.: 489,438

[22] Filed: Jun. 12, 1995

[51] Int. Cl.[6] ..... B42D 9/00

[52] U.S. Cl. ..... 281/42; 281/38

[58] Field of Search ..... 281/38, 42, 15.1, 281/51; 283/56; 116/234

[56] References Cited

U.S. PATENT DOCUMENTS

| | | | |
|---|---|---|---|
| Re. 34,759 | 10/1994 | Boyette . | |
| 732,527 | 6/1903 | Devlin | 281/38 |
| 4,184,699 | 1/1980 | Lowe, Jr. . | |
| 4,509,759 | 4/1985 | Small | 283/56 X |
| 4,614,364 | 9/1986 | Bortner . | |
| 5,022,681 | 6/1991 | Penick | 281/15.1 |
| 5,088,770 | 2/1992 | McCrea . | |
| 5,098,127 | 3/1992 | Williamson et al. | 281/15.1 |
| 5,382,053 | 1/1995 | Tanaka . | |

FOREIGN PATENT DOCUMENTS 807 808 7/1951 Germany .

OTHER PUBLICATIONS

Centerfold, "The New Yorker", Sep. 19, 1994.

Centerfold, "U.S. News & World Report", Apr. 24, 1995.

Centerfold, "Business Week", Apr. 17, 1995.

*Primary Examiner*—Willmon Fridie, Jr.

*Attorney, Agent, or Firm*—Shlesinger, Arkwright & Garvey LLP

[57] ABSTRACT

A bookmark and page combination for various publications, such as books, magazines, trade and professional journals, catalogs, etc., includes a page section for inclusion in the stacked pages of a publication. The page section includes a spine edge, a fore edge and top and bottom edges. A bookmark section is detachably connected to the page section along a tear line. The length and width dimensions of the page section preferably correspond to the length and width dimensions of the stacked pages of the publication. The width of the bookmark section is up to about four-tenths the width of the page section. A reader can simply detach the bookmark section from the page section and place it at a desired location in the publication.

8 Claims, 4 Drawing Sheets

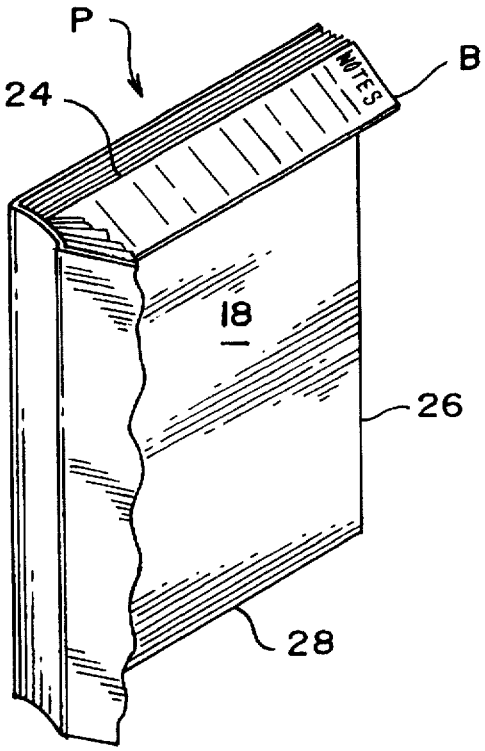
FIG. 6
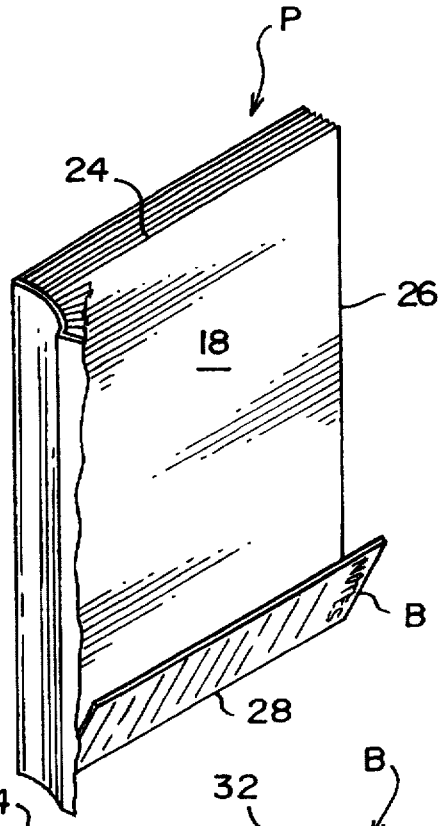
FIG. 7
FIG. 3
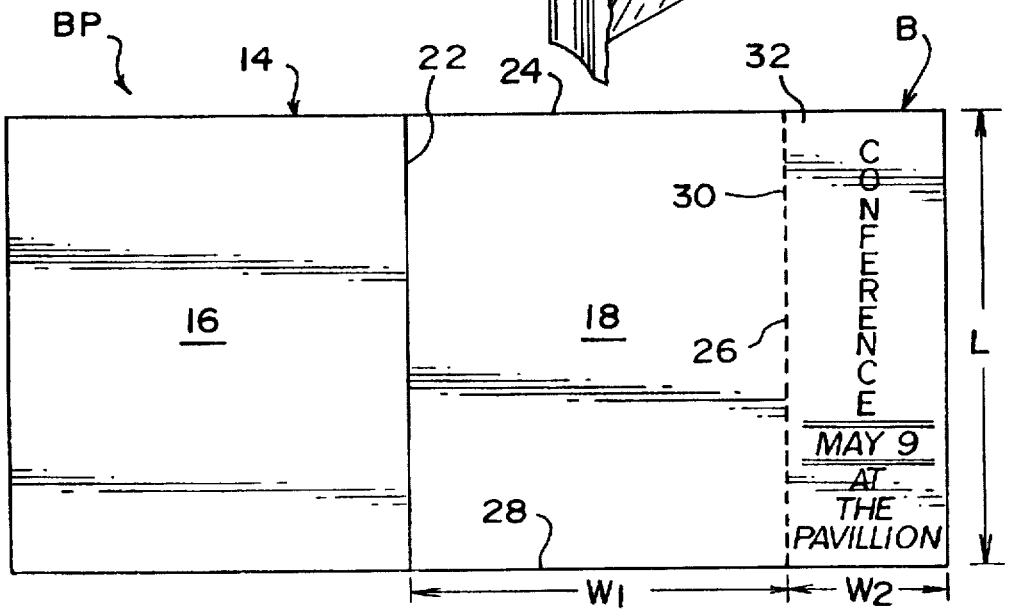

FIG. 5
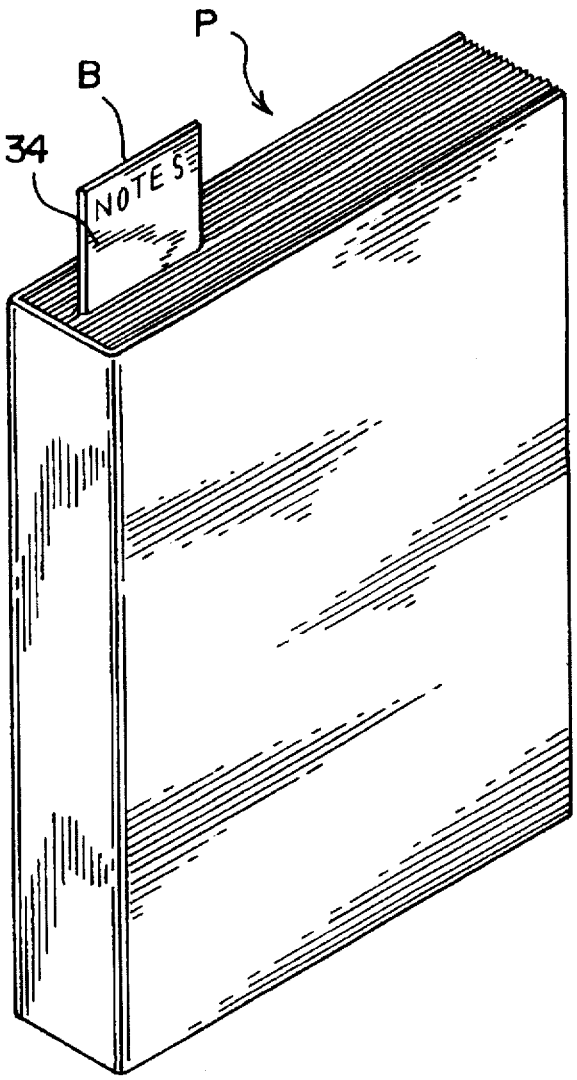
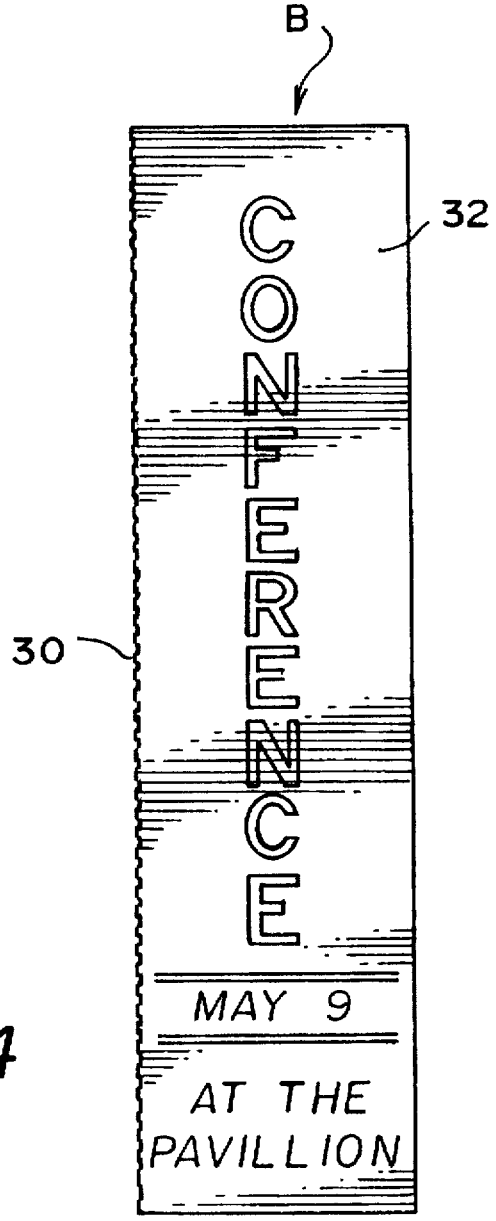
FIG. 4

BOOKMARK AND PAGE COMBINATION FOR A BOOK, MAGAZINE, TRADE JOURNAL, PROFESSIONAL JOURNAL, CATALOG, AND LIKE PUBLICATION

FIELD AND BACKGROUND OF THE INVENTION

The present invention is generally directed to bookmarks, and particularly to a bookmark and page combination for a book, magazine, trade journal, professional journal, catalog, and the like publication in which a plurality of pages are secured together at the spine edges of the pages.

It is not uncommon for a person reading or perusing books, magazines, professional or trade journals, etc., to mark a place for reference or return to in the future to continue with the reading of that publication. This is typically done by placing a small piece of paper in between the pages or by folding over a corner of the pertinent page. Neither of these techniques are very effective in that the small piece of paper may not be readily available or may become displaced or lost, and turned over corners become inconspicuous after the book or the publication has been closed thereby making the marked place difficult to find.

The present invention is directed to overcome these and other drawbacks associated with conventional bookmarks and the like devices and further offers a convenient means for reminding a reader of important dates. More specifically, trade and professional publications announce and publish dates and other pertinent information regarding upcoming conferences, meetings, shows, seminars, etc., in their respective publications. It is often difficult for a member-reader to easily locate the information regarding these events in a magazine as they are included among the rest of the text. Even in the instances where the particular page with the information about the events thereon is found, no means is provided to remind the reader of the pertinent information other than the conventional techniques available to the readers.

The known techniques are not only cumbersome and have drawbacks, but lead to confusion in that the reader has to mark in a magazine the page with the future events thereon along with other places in the magazine that may be of interest to the reader. This necessarily leads to multiple markings which is not desirable. In summary, none of the present devices or techniques provide a convenient bookmark which, in addition to facilitating the reader in marking a place of interest, reminds the reader of the dates for future events.

Various examples of bookmarks, tabs, or the like techniques are illustrated in U.S. Pat. Nos. 4,184,699; 4,614,364; 5,088,770; 5,382,053; Re 34,759; and German 807,808. We are further aware of product advertising centerfolds in various magazines which appear to be made of heavier grade paper than the remaining pages. A significantly wider strip, apparently made of the same grade paper as the centerfold, is foldably provided on the free edge of the right page of the centerfold. The strip can be detached from the connected page and includes two sections. One section is in the form of a reply card for the reader to mail out to the sponsor/advertiser to obtain more information about the product shown on the centerfold. The second section carries some information about the product displayed. The length of the reply card section appears to be more than one-half the length of the strip.

We are also aware of heavier grade product advertising pages in various magazines. Typically, a portion of the page is provided in the form of a reply card to be mailed out to the advertiser.

None of the presently known techniques or devices are suitable for a bookmark which functions to remind readers about dates/events of interest.

OBJECTS AND SUMMARY OF THE INVENTION

It is a principal object of the present invention to provide a bookmark and page combination for a book, magazine, trade journal, professional journal, catalog, and the like publication, which overcomes the drawbacks associated with conventional devices of this type and further offers a convenient means for reminding a reader about the information on various events of interest.

An object of the present invention is to provide a bookmark and page combination for various publications which offers a convenient and effective means for providing advertising indicia that stands out from the remainder of the publication.

Another object of the present invention is to provide a bookmark and page combination for various publications which, in addition to functioning as a bookmark, serves as a medium for advertisement.

It is yet another object of the present invention to provide a bookmark and page combination for various publications which provides a convenient and ready access to a bookmark.

An additional object of the present invention is to provide a bookmark and page combination in which the page section can be used for providing regular text of the magazine and the bookmark section can be easily separated and used as an effective and easy way for marking places in the publication.

Yet an additional object of the present invention is to provide a self-contained bookmark and page combination which can be easily produced and conveniently placed at a desired location in the magazine without incurring substantial extra expense.

An additional object of the present invention is to provide a bookmark and page combination which provides a readily accessible bookmark including a section for taking notes.

In summary, the present invention offers a bookmark and page combination which, in addition to being used as a bookmark, can be used as a reminder for upcoming events.

BRIEF DESCRIPTION OF THE DRAWINGS

The above and other objects and advantages and novel features of the present invention will become apparent from the following detailed description of the invention illustrated in the accompanying drawings, in which:

FIG. 3 is a top plan view of the bookmark and page combination of the invention;

FIG. 4 is a front elevational view of the bookmark of the invention;

FIG. 5 is a front perspective view of the publication showing the bookmark placed at a desired location therein;

FIG. 6 illustrates a second embodiment of the invention;

FIG. 7 illustrates a third embodiment of the invention; and

DETAILED DESCRIPTION OF THE INVENTION

In referring to FIGS. 1–3 and 4, a publication P including stacked pages 10 secured together at spine 12 thereof is shown. It is noted that publication P can be of any form, such as a book, magazine, trade journal, professional journal, catalog, brochures, newspaper, or the like publication. The publication may further be of hard or soft cover variety.

Figure 1:
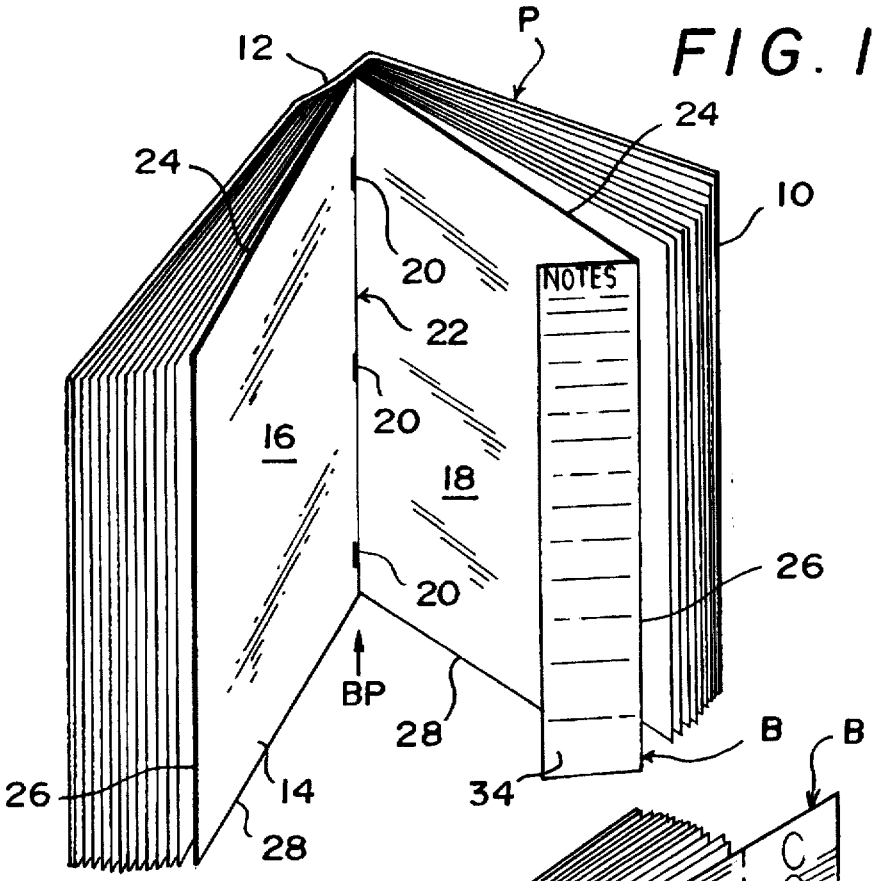
FIG. 1 is a perspective view of a publication, shown partly open with the bookmark and page combination mounted as the centerfold.

The bookmark and page combination BP, best shown in FIG. 1 and 3, has the configuration of a centerfold 14 having left and right pages 16 and 18. The centerfold 14 is secured to spine 12 of the publication by staples 20. It should be noted that any conventional means may be used to secure bookmark and page combination BP to publication P. Each of the left and right pages 16 and 18 includes spine edge 22, top edge 24, fore edge 26 and bottom edge 28. (For clarity, only page 18 has been marked to show various edges.)

Figure 2:
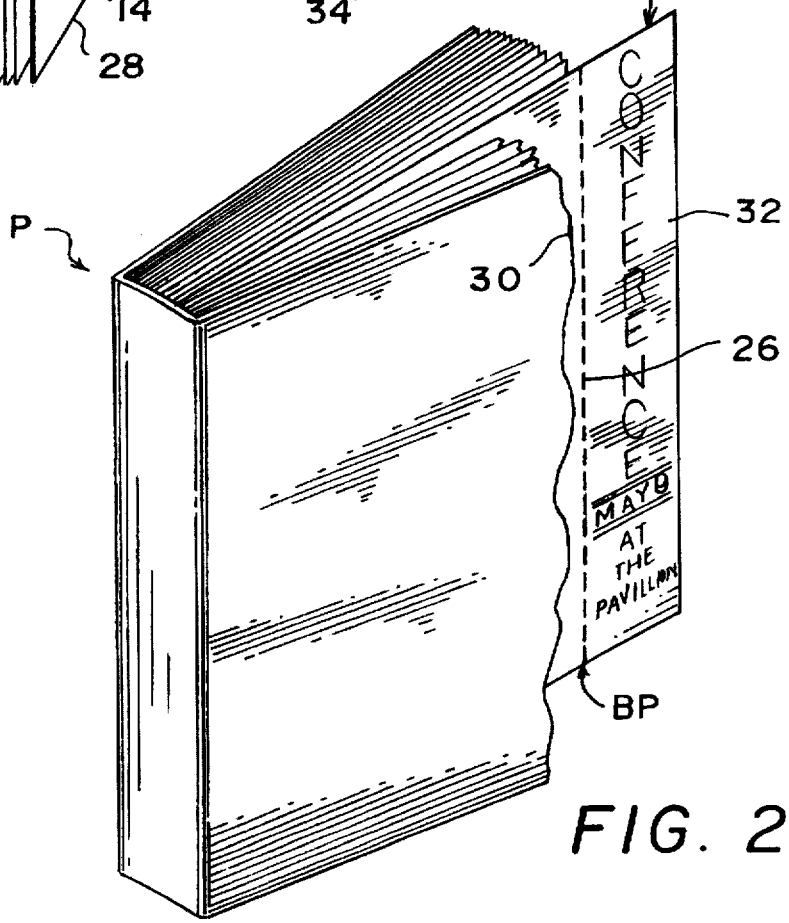
FIG. 2 is a partial front perspective view of the publication of FIG. 1, showing the bookmark in the unfolded position.

As best shown in FIGS. 1–3, a bookmark B in the form of a narrow strip is attached to the fore edge 26 of right page 18. The bookmark B is attached to fore edge 26 at tear line 30. The tear line 30 can be any conventional line, such as fold line, perforated line, crease line, etc., so long as bookmark B can be folded over page 18 and a reader can simply remove the bookmark B by tearing along line 30.

Although not necessary, it is preferable that the length and width dimensions of left and right pages 16 and 18 correspond to pages 10 of publication P. Similarly, the length L of the bookmark B preferably corresponds to the length of page 18 (see FIG. 3). The width $W_2$ of bookmark B, however, is significantly less than the width of either page 16 or 18. Preferably, as shown in FIG. 3, the width $W_2$ is up to about four-tenths the width $W_1$ of page 18. It should be noted that if the width $W_2$ of bookmark B is more than the preferred range specified herein, bookmark B would become bulky to function, and awkward to use, as a bookmark and would interfere with keeping the publication P in the closed position.

The bookmark B and pages 16 and 18 are preferably made of a paper material having the same weight grade. In particular, the bookmark and page combination BP is made of paper having a weight grade of about 60 to about 100 pounds. It should be noted that while this range is preferable, the bookmark and page combination BP may be made of other grade paper so long as it is heavier than the weight grade of pages 10 of the publication P. The reason for this is that heavier weight paper facilitates opening of a publication at the location where the heavier grade paper is positioned in the stacked pages.

As shown in FIG. 1, the bookmark B is folded over page 18 such that its rear surface 34 would be directly in front of the reader. As is readily apparent from FIG. 2, when bookmark B is unfolded, its front surface 32 would face the reader. As best shown in FIGS. 2–4, front surface 32 of bookmark B may be provided with information regarding a conference, meeting, or the like, and rear surface 34 can be rendered suitable for taking notes by the reader. It should, however, be noted that front and rear surfaces 32 and 34 can be used in any desired manner for placing information that may be of interest to a reader. For example, entire front and rear surfaces 32 and 34, or portions thereof, in any combination, may be used for displaying advertising indicia and the like.

Referring now to FIGS. 6 and 7 which illustrate alternative embodiments. In particular, FIG. 6 shows a portion of publication P in which bookmark B is secured to the top edge 24 of page 18. In another embodiment shown in FIG. 7, bookmark B is shown secured at the bottom edge 28 of page 18.

Figure 8:
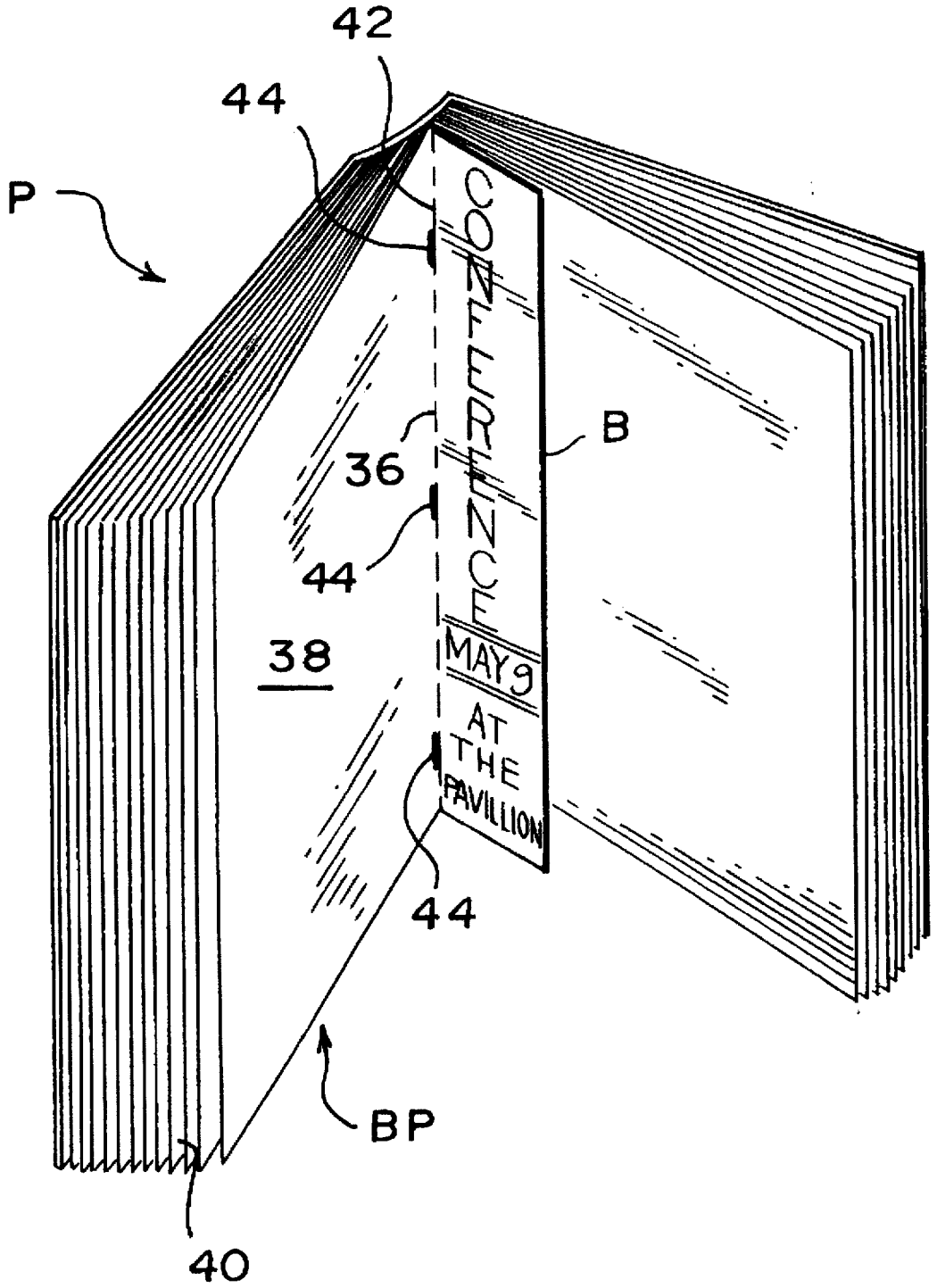
FIG. 8 illustrates a fourth embodiment of the invention.

As shown in FIG. 8, it is well within the scope of this invention to configure bookmark and page combination BP in such a manner that bookmark B is located along spine edge 36 of page 38. In other words, in this embodiment the bookmark and page combination BP includes only one page 38 having dimensions similar to the pages 40 of publication P. The combination BP is mounted in the publication P at the tear line 42 between bookmark B and page 38. Preferably, the tear line 42 is coincident with the spine edge 36 of page 38, and the staples 44 are placed along the tear line. It should be noted that the one page and bookmark combination BP shown in FIG. 8, can be configured in a manner that the tear line 42 is offset with spine edge 36.

In use, the reader separates bookmark B from page 18 by tearing alone line 30 and placing it in the publication P at a desired location (see FIG. 5). As evident, by placing front surface 32 of bookmark B toward the front of the publication, the reader would be constantly reminded of the information regarding an upcoming conference. Alternatively, as shown in FIG. 5, the reader by placing rear surface 34 of bookmark B towards the front of the publication, can remind him or herself of the information written thereon. The bookmark and page combination BP of the invention therefore serves as a bookmark B and also as a constant reminder of important events that the reader may be interested in.

While this invention has been described as having preferred designs, it is understood that it is capable of further modifications, uses and/or adaptations of the invention following in general the principle of the invention and including such departures from the present disclosure as come within known or customary practice in the art to which the invention pertains, and as may be applied to the essential features set forth, and fall within the scope of the invention or the limits of the appended claims.

What is claimed is:

1. A bookmark and page combination for a publication having a plurality of stacked pages secured together at spine edges thereof, the bookmark and page combination comprising:

a) a page section for inclusion in between the stacked pages of a publication;

b) said page section including a spine edge, a fore edge, top and bottom;

c) a bookmark section detachably connected to said page section along a tear line;

d) each of said page and bookmark sections having length and width dimensions;

e) the length and width dimensions of said page section substantially corresponding to the length and width dimensions of the stacked pages of the publication;

f) the width of said bookmark section being up to about one-third the width of said page section;

g) said bookmark section being pre-folded about said tear line to partially overlap said page section;

h) the length of said bookmark section substantially corresponding to the length of said page section;

i) said bookmark section being free of perforations extending transversely to said tear line; and, j) wherein said bookmark section may be detached from said page section by a user and placed at a desired location in the publication.

2. The bookmark and page combination of claim 1, wherein:

a) said bookmark and page sections are comprised of paper having a heavier weight grade than the weight grade of the stacked pages of the publication.

3. The bookmark and page combination of claim 2, wherein:

a) the weight grade of said bookmark and page sections is about 60 to about 100 lbs.

4. The bookmark section and page combination of claim 1, wherein:

a) said bookmark includes front and rear surfaces; and b) one of said front and rear surfaces includes indicia about future events.

5. The bookmark and page combination of claim 4, wherein:

a) the other of said front and rear surfaces includes advertising indicia.

6. The bookmark and page combination of claim 1, including a publication.

7. The bookmark and page combination of claim 4, wherein:

a) the other of said front and rear surfaces of said bookmark section includes a section for inscribing information.

8. The bookmark and page combination of claim 1, in combination with a magazine.

* * * * *